United States Patent [19]

Nagasawa et al.

[11] 4,045,374

[45] Aug. 30, 1977

[54] ZINC OXIDE VOLTAGE-NONLINEAR RESISTOR

[75] Inventors: Masahiro Nagasawa, Hirakata; Yasuo Wakahata, Chitose; Kensuke Kuchiba, Hirakata; Kunio Nishi, Chitose; Hiroshi Abe, Moriguchi, all of Japan

[73] Assignee: Matsushita Electric Industrial Co., Ltd., Japan

[21] Appl. No.: 621,622

[22] Filed: Oct. 10, 1975

[51] Int. Cl.[2] ..... H01B 1/00

[52] U.S. Cl. ..... 252/517; 252/518; 252/519; 252/521

[58] Field of Search ..... 252/517, 518, 519

[56] References Cited

U.S. PATENT DOCUMENTS

| | | | |
|---|---|---|---|
| 3,538,022 | 11/1970 | Bowman | 252/518 |
| 3,598,763 | 8/1971 | Matsuoka et al. | 252/518 |
| 3,663,458 | 5/1972 | Masuyama et al. | 252/518 |

FOREIGN PATENT DOCUMENTS

| | | | |
|---|---|---|---|
| 46-19480 | 5/1971 | Japan | 252/519 |

*Primary Examiner*—Richard D. Lovering
*Attorney, Agent, or Firm*—Wenderoth, Lind & Ponack

[57] ABSTRACT

A voltage-dependent resistor (varistor) of the bulk type comprising a sintered body consisting essentially of, as a main constituent, ZnO and additives of various metal oxides and further containing an additive of at least one of $Al_2O_3$, $In_2O_3$ $Ga_2O_3$ provide much improved characteristics, especially superior limiting voltage ratio, surge resistance and life of the varistor.

5 Claims, 1 Drawing Figure

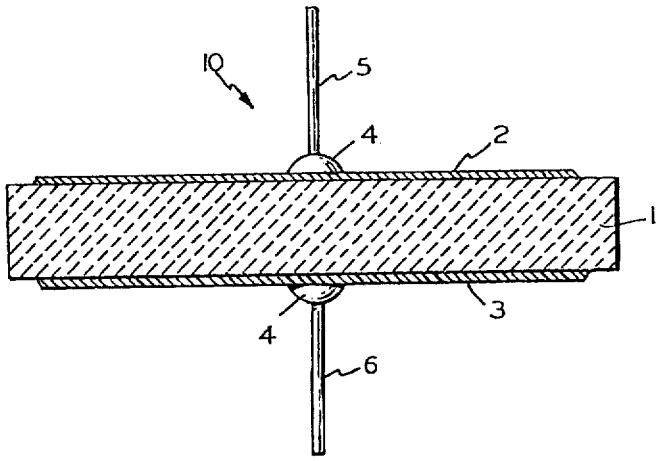
10
5
4
2
1
3
4
6

ZINC OXIDE VOLTAGE-NONLINEAR RESISTOR

This invention relates to a voltage-dependent resistor (varistor) having non-ohmic properties (voltage-dependent properties) due to the bulk thereof and more particularly to a voltage-dependent resistor, which is suitable as a surge absorber.

Various voltage dependent resistors such as silicon carbide voltage-dependent resistors, selenium rectifiers and germanium or silicon p-n junction diodes have been widely used for stabilization of voltage of electrical circuits or suppression of abnormally high surge induced in electrical circuits. The electrical characteristics of such voltage-dependent resistors are expressed by the relationship:

$$I=(V/C)^n \quad (1)$$

where V is the voltage across the resistor, I is the current flowing through the resistor, C is a constant corresponding to the voltage at a given current and exponent $n$ is a numerical value greater than 1, showing the degree of deviation from the ohmic characteristics of an ordinary resistor. The equation (1) is represented by a straight line of a slope $n$ when it is plotted for coordinates of logI vs. logV. However, for the conventional voltage-dependent resistors, there is a problem in that over the small current or large current ranges, the practical characteristics deviate from the equation (1) compared with the value over the intermediate range, i.e. the nonlinearity is degraded over the small current and large current ranges.

In a surge absorbing varistor such as the functional element of an arrestor or as an absorber for switching surges (used for suppressing an abnormally high surge directly generated or induced at a line), the voltage vs. current characteristic thereof over a large current range, e.g. higher than 100A, becomes an important factor. The terminal voltage of the surge absorbing varistor at a surge current such as 100A, 1KA and 100KA is designated a residual voltage at each surge current and is usually expressed by $V_{100A}$, $V_{1KA}$, $V_{10KA}$ and $V_{100KA}$, respectively. The voltage nonlinear characteristics of the varistor in the large current range is represented by the ratio of such residual voltage at a surge current and a terminal voltage $V_{1mA}$ at a normal small current (eg. 1mA). That is, the voltage nonlinear characteristic, i.e. surge absorbing capability, of the varistor becomes superior in accordance with decrease of that ratio. Therefore, that ratio such as $V_{100A}/V_{1mA}$ and $V_{1KA}/V_{1mA}$ is designated a limiting voltage ratio at respective currents of 100A and 1 KA, as a factor showing the surge absorbing capability.

Further, another important factor of a surge absorbing varistor is how high a surge current the varistor can withstand. Herein, surge resistance is defined by a peak value of a current pulse (such as a pulse having a duration of wave front of 8 μsec and duration of wave tail of 20 μsec) which causes 10% permanent change to $V_{1mA}$. Besides, a degree of degradation of the electric characteristics of the varistor (life characteristic) when a certain constant current pulse is applied repetitively is also an important factor.

In the conventional varistors as described above, a bulk-type zinc oxide varistor comprising zinc oxide as a main constituent and additives of various oxides is known as having various superior characteristics with respect to other known ones. However, even such zinc oxide varistor does not provide satisfactory characteristics for a large current range (eg. current range higher than 100A) discussed herewith. In order to improve the characteristics of the zinc oxide varistors over the large current range, it has been proposed to add various fluorides. For example, U.S. Pat. Nos. 3,805,114, 3,806,765, 3,811,103 and 3,838,378 disclose addition of $CoF_2$, $MnF_2$, $NiF_2$ and $CeF_3$, respectively for this purpose. However, it is difficult to practically employ such a method because of various problems such as corrosion of manufacturing equipment due to poisonous $F_2$ gas generated during manufacture and the requirement for large scale equipment to prevent air pollution.

Therefore, an object of the present invention is to provide a new and improved zinc oxide varistor of the bulk type having a small value of the limiting voltage ratio without using fluorides.

Another object of the invention is to provide an improved zinc oxide varistor of the bulk type having a high surge resistance without using any fluorides.

A further object of the invention is to provide an improved zinc oxide varistor of bulk type showing less degradation against a current pulse without using fluorides.

These objects are realized by a zinc oxide varistor of bulk type according to the present invention, which comprises a sintered body having a voltage-dependent composition which consists essentially of, as a main constituent, zinc oxide, and additives of the other metal oxides, and further at least one member selected from the group consisting of $Al_2O_3$, $In_2O_3$ and $Ga_2O_3$ in an amount of $2 \times 10^{-5}$ to $1 \times 10^{-2}$ mole per 100 moles of ZnO, and electrodes applied to opposite surfaces of said sintered body. The voltage-dependent composition described above refers to a composition comprising ZnO as a main constituent, and as additives, at least one member selected from the group consisting of $Bi_2O_3$, BaO, SrO, PbO and $UO_2$, and preferably further, at least one member selected from the group consisting of CoO, MnO, $Sb_2O_3$, $Cr_2O_3$ and $SiO_2$. It is well known that a sintered body having such composition exhibits voltage-dependent characteristics.

These and other objects of this invention will become apparent upon consideration of the following detailed description taken together with the accompanying drawing in which the single FIGURE is cross-sectional view of a voltage dependent resistor, in accordance with this invention.

Before proceeding with a detailed description of the manufacturing process of the voltage-dependent resistor contemplated by this invention, its construction will be described with reference to the single FIGURE wherein reference numeral 10 designates, as a whole, a voltage-dependent resistor comprising, as its active element, a sintered body having a pair of electrodes 2 and 3 in an ohmic contact applied to opposite surfaces thereof. The sintered body 1 is prepared in a manner hereinafter set forth and is any form such as circular, square or rectangular plate. Wire leads 5 and 6 are attached conductively to the electrodes 2 and 3, respectively, by a connection means 4 such as solder or the like.

It has been discovered according to the invention that a voltage-dependent resistor comprising a sintered body of a composition of the voltage-dependent composition described above and, as a further additive, a small amount of at least one member selected from the group consisting of $Al_2O_3$, $In_2O_3$ and $Ga_2O_3$ has much improved characteristics e.g. with respect to limiting voltage ratio at a large current range, surge resistance and extended life.

Although U.S. Pat. No. 3,663,458 discloses that for a zinc oxide varistor of a bulk type, an addition of 0.05 to 10 mole % of $Al_2O_3$ or $In_2O_3$ is effective to decrease the varistor voltage, which corresponds to a value of C in the equation (1), addition of such comparatively large amount of $Al_2O_3$ or $In_2O_3$ is not effective to improve the limiting voltage ratio, such as $V_{100A}/V_{1mA}$ or $V_{1KA}/V_{1mA}$, in a large current range, as intended in the present invention. The large effect achieved by addition of at least one of $Al_2O_3$, $In_2O_3$ and $Ga_2O_3$ in a small amount, which is far less than that of the additive disclosed in the aforesaid U.S. Pat. No. 3,663,458, is neither disclosed nor taught by the prior art.

For the additives according to the present invention, it is possible to use a single compound of $Al_2O_3$, $In_2O_3$ or $Ga_2O_3$ or to use a mixture thereof. Further, although the additives are described as $Al_2O_3$, $In_2O_3$ and $Ga_2O_3$ herewith for convenience, they are not limited to these oxides. For practical manufacture, it is also possible to employ hydroxides or salts of these elements, aluminum, indium and gallium, when they are converted to the aforesaid oxide by firing in air.

It was found from these the experiments that an operable amount of the additive according to the present invention to provide the desired effects is $2 \times 10^{-5}$ to $1 \times 10^{-2}$ mole per 100 moles of ZnO, and preferably $1 \times 10^{-4}$ to $5 \times 10^{-3}$ mole per 100 moles of ZnO, as can be also observed from the examples described hereinafter. For an amount of the additive less than $1 \times 10^{-2}$ mole %, all of the characteristics described above, i.e. limiting voltage ratio, surge resistance and life characteristics for pulses are improved in comparison to those without the additive of the invention. However, for an amount of more than $1 \times 10^{-2}$ mole %, some of these characteristics, e.g. $V_{100A}/V_{1mA}$, are degraded in comparison to no addition. For the amount of $1 \times 10^{-4}$ to $5 \times 10^{-3}$ mole %, not only these characteristics are remarkably improved, but also as each of these characteristics becomes insensitive to deviation of the amount of the additive, it becomes possible to manufacture the products of the varistor with high reproducibility.

Of the additives $Al_2O_3$, $In_2O_3$ and $Ga_2O_3$ according to the invention, $Ga_2O_3$ is the most effective for improving the aforesaid characteristics. $Al_2O_3$ is next most effective, and it has an advantage of utilizing a low cost raw material. The features of the present invention are suitable for any of conventional composition of a zinc oxide varistor, and especially for the following composition there is provided a zinc oxide varistor having excellently superior surge absorbing capabilities according to the invention: 80 to 99.91 mole % of ZnO, 0.01 to 10 mole % of $Bi_2O_3$, 0.01 to 10 mole % of CoO, 0.01 to 10 mole % of MnO, 0.01 to 10 mole % of $Sb_2O_3$, and 0.01 to 10 mole % of at least one member selected from the group consisting of $Cr_2O_3$, $SnO_2$, $SiO_2$, NiO and MgO.

The following examples are meant to illustrate preferred embodiment of this invention, but are not meant to limit the scope thereof.

EXAMPLE 1

A mixture of 97 mole % of ZnO, 0.5 mole % of $Bi_2O_3$, 0.5 mole % of CoO, 0.5 mole % of MnO, 1.0 mole % of $Sb_2O_3$ and 0.5 mole % of $SnO_2$ was prepared, and further, $Al_2O_3$ was added to the mixture in an amount of up to 0.1 mole per 100 moles of ZnO. The mixture was well mixed in a wet ball mill. Then, the mixture was dried and pressed in mold discs of 17.0 mm diameter and 3 mm thickness by a per se well known method. The pressed bodies were sintered in air at a temperature of 1200° to 1350° C for one hour. The opposite surfaces of the sintered body were provided with a spray metallized film of aluminum in a per se well known technique. By applying a pair of lead wires to the aluminum films, the varistor was completed.

Table 1 shows the measured results of the characteristics of the resultant varistors, i.e. the two limiting voltage ratios $V_{100A}/V_{1mA}$ and $V_{1KA}/V_{1mA}$, surge resistance and life of the varistors. The life is expressed by a change ratio of the initial voltage $V_{1mA}$ and that realized after applying a current pulse of 100A of peak value, 8 μsec of wave front duration and 20 μsec of wave tail duration repetitively for $10^5$ times for 10 sec.

EXAMPLE 2

ZnO varistors were made by the method of Example 1, replacing $Al_2O_3$ by $In_2O_3$. Table 2 shows the measured results of the limiting voltage ratios $V_{100A}/V_{1mA}$ and $V_{1KA}/V_{1mA}$ of the resultant varistors.

EXAMPLE 3

ZnO varistors were made by the method of Example 1, replacing $Al_2O_3$ by $Ga_2O_3$. Table 2 shows the measured results of the limiting voltage ratios of $V_{100A}/V_{1mA}$ and $V_{1KA}/V_{1mA}$ of the resultant varistors.

EXAMPLE 4

ZnO varistors were made by the method of Example 1, replacing $Al_2O_3$ by a mixture of $Al_2O_3$ and $In_2O_3$ of the same mole. Table 3 shows the measured results of the limiting voltage ratio $V_{1KA}/V_{1mA}$ of the resultant varistors.

EXAMPLE 5

ZnO varistors were made by the same method of that of Example 1, replacing $Al_2O_3$ by a mixture of $Al_2O_3$ and $Ga_2O_3$ of the same mole. Table 3 shows the measured results of the limiting voltage ratio $V_{1KA}/V_{1mA}$ of the resultant varistors.

EXAMPLE 6

ZnO varistors were made by the same method as that of Example 1, replacing $Al_2O_3$ by a mixture of $Al_2O_3$, $In_2O_3$ and $Ga_2O_3$ of the same mole. Table 3 shows the measured results of the limiting voltage ratio $V_{1KA}/V_{1mA}$ of the resultant varistors.

EXAMPLE 7

ZnO varistors were made by the same method as that of Example 1, for the various compositions of 85 to 99.98 mole % of ZnO, 0.01 to 10 mole % of $Bi_2O_3$ and 0.01 to 10 mole % of CoO, with the further addition of $1 \times 10^{-4}$ to $5 \times 10^{-3}$ mole of $Al_2O_3$ per 100 moles of ZnO. Table 4 compares the measured results of the limiting voltage ratio $V_{1KA}/V_{1mA}$ and the surge resistances with those for varistors having no addition of $Al_2O_3$.

EXAMPLE 8

ZnO varistors were made by the method of Example 1, for the various compositions of 80 to 99.95 mole % of ZnO, each 0.01 to 10 mole % of $Bi_2O_3$, CoO, MnO, $Sb_2O_3$ and $Cr_2O_3$, and further, addition of $1 \times 10^{-4}$ to 5

$\times 10^{-3}$ mole of $Al_2O_3$ per 100 moles of ZnO. Table 4 shows the measured results of the limiting voltage ratio $V_{1KA}/V_{1mA}$ and the surge resistance compared with those of varistors having no addition of $Al_2O_3$.

EXAMPLE 9

ZnO varistors were made by the method of Example 1, for the various compositions of 80 to 99.95 mole % of ZnO, each 0.01 to 10 mole % of $Bi_2O_3$, CoO, MnO, $Sb_2O_3$, NiO, MgO and $SiO_2$, and further addition of $1 \times 10^{-4}$ to $5 \times 10^{-3}$ mole of $Al_2O_3$ per 100 moles of ZnO. Table 4 shows the measured results of the limiting voltage ratio $V_{1KA}/V_{1mA}$ and the surge resistance compared with those of varistors having no addition of $Al_2O_3$.

EXAMPLE 10

ZnO varistors were made by the method of Example 1, for the various compositions of 80 to 99.96 mole % of ZnO, each 0.01 to 10 mole % of $Bi_2O_3$, CoO, MnO, $Sb_2O_3$, $Cr_2O_3$, NiO, MgO and $SiO_2$, and further addition of $1 \times 10^{-4}$ to $5 \times 10^{-3}$ mole of $Al_2O_3$ per 100 moles of ZnO. Table 4 shows the measured results of the limiting voltage ratio $V_{1KA}/V_{1mA}$ and the surge resistance together with those of the varistors having no addition of $Al_2O_3$ for comparison.

Each of the compounds used in the above examples had very high purity, and the entire aluminum of $Al_2O_3$, $In_2O_3$ or $Ga_2O_3$ to be added it was $0.2 \times 10^{-5}$ to $1 \times 10^{-5}$ mole in form of $Al_2O_3$, $In_2O_3$ or $Ga_2O_3$ per 100 moles of ZnO.

Table 1

| amount of added $Al_2O_3$(mole) | $V_{100A}/V_{1mA}$ | $V_{1kA}/V_{1mA}$ | surge resistance (A) | change ratio of $V_{1mA}$ (%) |
|---|---|---|---|---|
| 0 | 1.99 | 3.12 | 1860 | −8.7 |
| $2 \times 10^{-5}$ | 1.73 | 2.56 | 5600 | −5.5 |
| $5 \times 10^{-5}$ | 1.47 | 2.09 | 10000 | −1.4 |
| $1 \times 10^{-4}$ | 1.38 | 1.81 | 15800 | +0.4 |
| $2 \times 10^{-4}$ | 1.36 | 1.74 | 22400 | +0.7 |
| $5 \times 10^{-4}$ | 1.35 | 1.71 | 33800 | +0.7 |
| $1 \times 10^{-3}$ | 1.36 | 1.71 | 42600 | +8.6 |

Table 1-continued

| amount of added $Al_2O_3$(mole) | $V_{100A}/V_{1mA}$ | $V_{1kA}/V_{1mA}$ | surge resistance (A) | change ratio of $V_{1mA}$ (%) |
|---|---|---|---|---|
| $2 \times 10^{-3}$ | 1.38 | 1.74 | 49000 | +0.5 |
| $5 \times 10^{-3}$ | 1.45 | 1.98 | 46800 | +0.1 |
| $1 \times 10^{-2}$ | 1.78 | 2.70 | 26300 | −2.5 |
| $2 \times 10^{-2}$ | 2.18 | 3.04 | 12000 | −7.5 |
| $5 \times 10^{-2}$ | 2.43 | 3.31 | 2240 | −17.5 |
| $1 \times 10^{-1}$ | 2.56 | — | ≦1000 | −22.0 |
| $2 \times 10^{-1}$ | 2.65 | — | <1000 | — |

Table 2

| amount of added $In_2O_3$ or $Ga_2O_3$ | Example 2 $V_{100A}/V_{1mA}$ | Example 2 $V_{1kA}/V_{1mA}$ | Example 3 $V_{100A}/V_{1mA}$ | Example 3 $V_{1kA}/V_{1mA}$ |
|---|---|---|---|---|
| 0 | 1.99 | 3.12 | 1.99 | 3.12 |
| $2 \times 10^{-5}$ | 1.77 | 2.57 | 1.69 | 2.40 |
| $5 \times 10^{-5}$ | 1.61 | 2.26 | 1.53 | 2.01 |
| $1 \times 10^{-4}$ | 1.53 | 2.10 | 1.43 | 1.88 |
| $2 \times 10^{-4}$ | 1.45 | 1.97 | 1.38 | 1.72 |
| $5 \times 10^{-4}$ | 1.44 | 1.93 | 1.37 | 1.66 |
| $1 \times 10^{-3}$ | 1.44 | 1.94 | 1.37 | 1.66 |
| $2 \times 10^{-3}$ | 1.46 | 1.95 | 1.38 | 1.68 |
| $5 \times 10^{-3}$ | 1.50 | 2.06 | 1.44 | 1.84 |
| $1 \times 10^{-2}$ | 1.67 | 2.40 | 1.58 | 2.11 |
| $2 \times 10^{-2}$ | 1.86 | 2.89 | 1.86 | 2.63 |
| $5 \times 10^{-2}$ | 2.30 | 3.30 | 2.25 | 3.00 |
| $1 \times 10^{-1}$ | 2.48 | — | 2.42 | 3.16 |
| $2 \times 10^{-1}$ | 2.58 | — | 2.53 | 3.30 |

Table 3

| amount of additive (mole) | Example 4 ($Al_2O_3 + In_2O_3$) $V_{1kA}/V_{1mA}$ | Example 5 ($Al_2O_3 + Ga_2O_3$) $V_{1kA}/V_{1mA}$ | Example 6 ($Al_2O_3 + In_2O_3 + Ga_2O_3$) $V_{1kA}/V_{1mA}$ |
|---|---|---|---|
| 0 | 3.12 | 3.12 | 3.12 |
| $2 \times 10^{-5}$ | 2.57 | 2.42 | 2.45 |
| $5 \times 10^{-5}$ | 2.27 | 2.05 | 2.08 |
| $1 \times 10^{-4}$ | 2.05 | 1.86 | 1.83 |
| $2 \times 10^{-4}$ | 1.96 | 1.73 | 1.76 |
| $5 \times 10^{-4}$ | 1.92 | 1.68 | 1.71 |
| $1 \times 10^{-3}$ | 1.92 | 1.67 | 1.70 |
| $2 \times 10^{-3}$ | 1.95 | 1.68 | 1.72 |
| $5 \times 10^{-3}$ | 2.04 | 1.88 | 1.85 |
| $1 \times 10^{-2}$ | 2.39 | 2.09 | 2.03 |
| $2 \times 10^{-2}$ | 2.84 | 2.61 | 2.64 |
| $5 \times 10^{-2}$ | 3.29 | 3.00 | 3.05 |
| $1 \times 10^{-1}$ | — | 3.15 | 3.18 |
| $2 \times 10^{-1}$ | — | 3.31 | 3.36 |

Table 4

| Ex. | composition (mole %) | | Sample of Invention (addition of $Al_2O_3$) $V_{1kA}/V_{1mA}$ | surge resistance (kA) | Conventional Sample (no addition of $Al_2O_3$) $V_{1kA}/V_{1mA}$ | surge resistance (kA) |
|---|---|---|---|---|---|---|
| 7 | ZnO | 85~99.98 | | | | |
| | $Bi_2O_3$ | 0.01~10 | 2.5~5 1~4 | 8~11 | 0.01~0.1 | |
| | CoO | 0.01~10 | | | | |
| 8 | ZnO | 80~99.95 | | | | |
| | $Bi_2O_3$ | 0.01~10 | | | | |
| | CoO | 0.01~10 | | | | |
| | MnO | 0.01~10 | 1.6≈2.4 | 10~50 | 2~10 | 0.3~5 |
| | $Sb_2O_3$ | 0.01~10 | | | | |
| | $Cr_2O_3$ | 0.01~10 | | | | |
| 9 | ZnO | 80~99.93 | | | | |
| | $Bi_2O_3$ | 0.01~10 | | | | |
| | CoO | 0.01~10 | | | | |
| | MnO | 0.01~10 | | | | |
| | $Sb_2O_3$ | 0.01~10 | 1.6≈2.4 | 10~50 | 2.2≈3.6 | 0.2~3 |
| | NiO | 0.01~10 | | | | |
| | MgO | 0.01~10 | | | | |
| | $SiO_2$ | 0.01~10 | | | | |
| 10 | ZnO | 80~99.92 | | | | |
| | $Bi_2O_3$ | 0.01~10 | | | | |
| | CoO | 0.01~10 | | | | |
| | MnO | 0.01~10 | | | | |
| | $Sb_2O_3$ | 0.01~10 | 1.6~2.4 | 10~50 | 2.5~3.4 | 0.2~3 |
| | $Cr_2O_3$ | 0.01~10 | | | | |
| | NiO | 0.01~10 | | | | |
| | MgO | 0.01~10 | | | | |
| | $SiO_2$ | 0.01~10 | | | | |

What is claimed is:

1. A voltage-dependent resistor of bulk type comprising a sintered body consisting essentially of a voltage-dependent composition which comprises, as a main constituent, zinc oxide (ZnO) and, as an additive, at least one member selected from the group consisting of bismuth oxide ($Bi_2O_3$), barium oxide (BaO), strontium oxide (SrO), lead oxide (PbO) and uranium oxide ($UO_2$), and, as a further additive, at least one member selected from the group consisting of aluminum oxide ($Al_2O_3$), indium oxide ($In_2O_3$) and gallium oxide ($Ga_2O_3$) in an amount of $1 \times 10^{-4}$ to $5 \times 10^{-3}$ mole per 100 moles of ZnO, and electrodes applied to opposite surfaces of said sintered body.

2. A voltage-dependent resistor according to claim 1, wherein said further additive is $Ga_2O_3$.

3. A voltage-dependent resistor according to claim 1, wherein said further additive is $Al_2O_3$.

4. A voltage-dependent resistor according to claim 1, wherein said voltage dependent composition further comprises at least one member selected from the group consisting of cobalt oxide (CoO), manganese oxide (MnO), antimony oxide ($Sb_2O_3$), chromium oxide ($Cr_2O_3$) and silicon oxide ($SiO_2$).

5. A voltage-dependent resistor according to claim 1, wherein said voltage-dependent composition comprises 80 to 99.95 mole % of ZnO, 0.01 to 10 mole % of $Bi_2O_3$, 0.01 to 10 mole % of CoO, 0.01 to 10 mole % of MnO, 0.01 to 10 mole % of $Sb_2O_3$ and 0.01 to 10 mole % of at least one member selected from the group consisting of $Cr_2O_3$, $SnO_2$, $SiO_2$, NiO and MgO.

* * * * *